United States Patent [19]

Johnston

[11] 4,142,597

[45] Mar. 6, 1979

[54] MECHANICAL DETENT JARS

[75] Inventor: Russell A. Johnston, Lewisville, Tex.

[73] Assignee: Otis Engineering Corporation, Dallas, Tex.

[21] Appl. No.: 786,059

[22] Filed: Apr. 8, 1977

[51] Int. Cl.[2] ..... E21C 19/00

[52] U.S. Cl. ..... 175/304; 175/299; 175/300; 166/178

[58] Field of Search ..... 166/178; 175/293, 299, 175/300, 302, 304

[56] References Cited

U.S. PATENT DOCUMENTS

| | | | |
|---|---|---|---|
| 2,008,743 | 7/1935 | Black | 175/304 |
| 2,126,241 | 8/1938 | Black | 175/304 X |
| 3,203,482 | 8/1965 | Lyles | 166/178 |
| 3,406,770 | 10/1968 | Arterbury et al. | 175/299 |

*Primary Examiner*—Ernest R. Purser
*Assistant Examiner*—Nick A. Nichols, Jr.
*Attorney, Agent, or Firm*—Vinson & Elkins

[57] ABSTRACT

A jar for use in facilitating the removal of stuck objects from wells. The jar has a telescoping assembly held in a collapsed position by a latching means urged into latching position by a resilient means so that the hammer of the jar is spaced from the anvil thereof. The release of the latching means is actuated by a predetermined longitudinal force applied to the upper end of the jar which overcomes the resilient means to cause the hammer to strike the anvil with a sudden impact translated by a connecting means from the jar to the stuck object.

14 Claims, 8 Drawing Figures

MECHANICAL DETENT JARS

BACKGROUND OF THE INVENTION

During well operations equipment can become lodged in a well bore and simply pulling on the stuck object will not release it from the retained position in the well. In order to loosen stuck objects, jarring devices designed to impact a sudden force are used in conjunction with fishing tools such as spears or overshots that are attached to the objects.

The usual jarring tools utilize a latch means depending upon its resiliency or an associated resilient means to maintain the means in latched position. Upon a predetermined upward tension applied to the jarring tool, the resilient force holding the latch means in place is overcome and the latch means is disengaged from its latched position. In the case of a latch means formed by spring-like collet fingers, the fingers are subject to constant flexing which results in fatigue and loss of elasticity, whereby the fingers become ineffective after a relatively short period of use. Also, the collet fingers include latching shoulders which are relatively small and become worn to the extent that their holding ability is greatly decreased.

Other types of latch means, such as ball detents have been used but here again, the holding balls are subjected to constant wear which decreases their effectiveness. Such ball detents have the additional disadvantage of being difficult to mount and maintain in position in annular carriers, and experience has shown that balls become dislodged from their carrying position and jam the tool or are completely displaced and lost. Examples of such prior jars are shown in U.S. Pat. Nos. 3,406,770 and 3,203,482.

SUMMARY OF THE INVENTION

The present invention uses a sturdy latch or latching means instead of inherently resilient devices, such as collet fingers and ball detent carriers. The latch means, because it is rugged, can be used repeatedly without becoming worn and is constructed so as to prevent jamming. The tool is designed to attach to conventional fishing tools and is used in the well-known manner of common jarring devices.

Also, the invention provides an apparatus designed for repetitive use in jarring operations to loosen stuck objects in wells without becoming ineffective because of failure of certain components.

OBJECTS OF THE INVENTION

It is an object of this invention to provide an improved sturdy jar to be suspended from a wire line and used in conjunction with conventional fishing tools to facilitate removal of stuck objects from the well.

A further object of this invention is to provide an improved jar designed with rugged latch means interposed between two telescoping members, one of which carries the anvil and the other of which has the hammer mounted thereon, said means being constructed to withstand repetitive use without losing its effectiveness due to excessive wear.

Another object of this invention is to provide an improved latch mechanism for a jar in which the latching components are securely assembled and co-act in such a manner that they will not unintentionally become disengaged or become separated due to excessive wear.

An additional object of this invention is to provide an improved, sturdy jar which can be constructed of relatively small diameter and of relatively short length so that it is adaptable for use in pump down operations.

DESCRIPTION OF THE PREFERRED EMBODIMENTS

Figure 1:
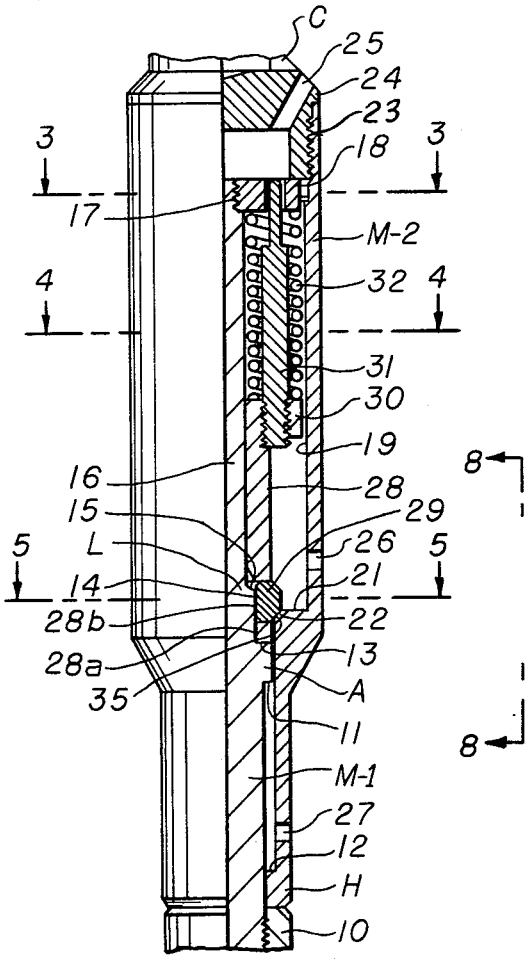
FIG. 1 is a longitudinal view partly in section and partly in elevation, of the jar in a collapsed position.
Figure 2:
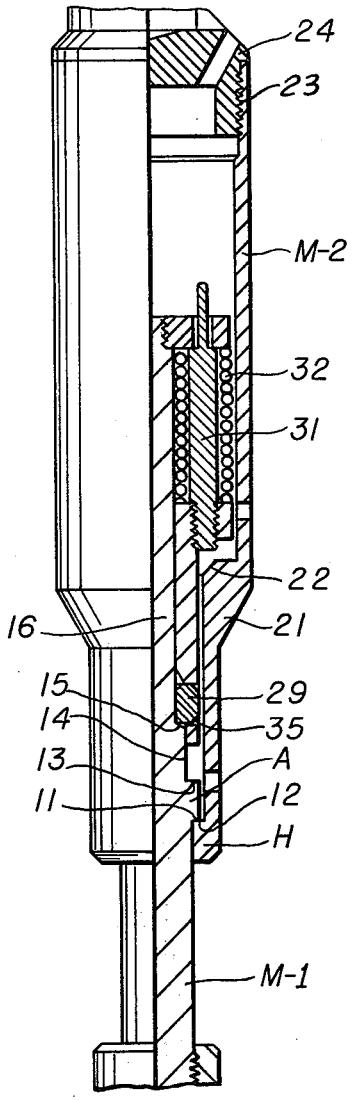
FIG. 2 is a similar view of the jar in its extended position.
Figure 3:
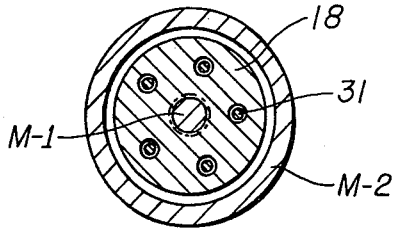
FIG. 3 is a horizontal cross-sectional view, taken at line 3—3 of FIG. 1.

A jar of the present invention generally comprises an inner support member M-1 adapted to be attached through a coupling 10 to the usual overshot or other device which in turn, is adapted to grab the stuck object (not shown) in the well. The member M-1 has an annular anvil A formed intermediate the ends of said member; the anvil has a downwardly facing external anvil surface 11. An outer member M-2 telescopes the inner member and has a hammer H formed on the lower end thereof, with said hammer having an upwardly facing internal annular hammer surface 12. The upper end of the outer member M-2 is connected through a suitable coupling C to a wire line. A latch generally indicated by the letter L is disposed between the inner and outer members above the anvil A and normally latches the members in their collapsed position with the hammer spaced from the anvil (FIG. 1). Upon release of the latch L, the outer member telescopes upwardly causing the hammer H to strike the anvil and apply an upward jar to the stuck object (FIG. 2).

The inner support member M-1 comprises an elongate, solid, generally cylindrical rod having an annular external enlargement intermediate its ends to form the anvil A. The lower surface of the anvil has the downwardly facing anvil surface 11 while the upper surface 13 of said anvil provides an annular support shoulder. Immediately above such support shoulder the member M-1 has an annular back-up or locking surface 14 which, as will be explained, co-acts with other components of the latch L. The portion 16 of the member M-1 extending upwardly from the back-up surface is reduced in diameter and an annular beveled surface 15 extends between the back-up surface and such reduced diameter portion. The upper end of member M-1 is externally threaded at 17 to receive a collar 18 which is slidable within the bore 19 of the outer axially telescoping member M-2. Below the anvil surface 11, the member M-1 extends downwardly through the outer member and connects to coupling 10.

Telescoping and slidable mandrel member M-2 has the upwardly facing hammer surface 12 at its lower end. Spaced between the upper and lower ends of the outer member M-2 is latching shoulder 21 which has a beveled inner surface 22. Above the latching shoulder the bore 19 of M-2 is enlarged to house other components of the jar. The upper end of M-2 is internally threaded at 23 to receive retainer cap 24 which encloses the top of the jar. The retainer cap and member M-2 have equalizing ports 25, 26 and 27 drilled in them to allow equalization of pressure between the interior and exterior of the tool in the various positions of members M-1 and M-2 during the use of the tool.

A carrier sleeve 28 is interposed between the members M-1 and M-2 and has its lower end resting on upper surface 13 of the anvil A formed on member M-1. The sleeve is slidable on the reduced diameter upper portion 16 of member M-1 and the lower portion of the bore of the sleeve is enlarged at 28*a* to engage the back-up or locking surface 14. The carrier sleeve has windows 28*b* in its lower portion for receiving and carrying radially movable latching dogs 29 adapted to move between projecting or retracting positions. With the parts in the position shown in FIG. 1, members M-1 and M-2 are latched in a manner to keep the hammer spaced from the anvil when the latching dogs are fully projected through the windows. The windows 28*b* are located in the lower portion of the carrier sleeve to position the latch dogs between the back-up surface 14 and the beveled surface 22 of the latching shoulder 21.

Figure 4:
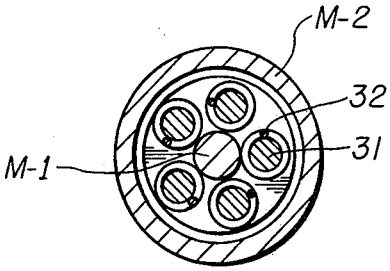
FIG. 4 is a horizontal cross-sectional view, taken at line 4—4 of FIG. 1.

The upper end of the carrier sleeve 28 has an outwardly extending flange 30 into which the lower end of a plurality of upwardly extending guide pins 31 are secured (FIG. 4). Each pin is reduced at its upper end to extend through vertical holes in the collar 18 which is threaded onto the upper end of the member M-1. For the purpose of applying a constant downward resilient force to the carrier sleeve a coiled spring 32 surrounds each pin and is confined between the flange 30 and collar 18. Another embodiment of the improved jar would contain a single resilient means or spring contained in the bore of the outer member M-2 and confined between flange 30 and collar 18. When the jar is in collapsed position, the upper surface of collar 18 abuts the lower surface of retainer cap 24.

Figure 5:
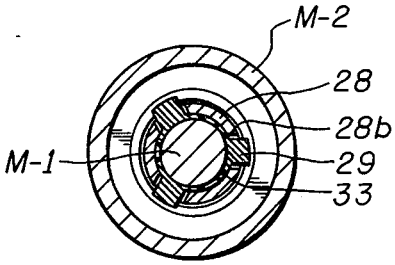
FIG. 5 is a horizontal cross-sectional view, taken at line 5—5 of FIG. 1.
Figure 6:
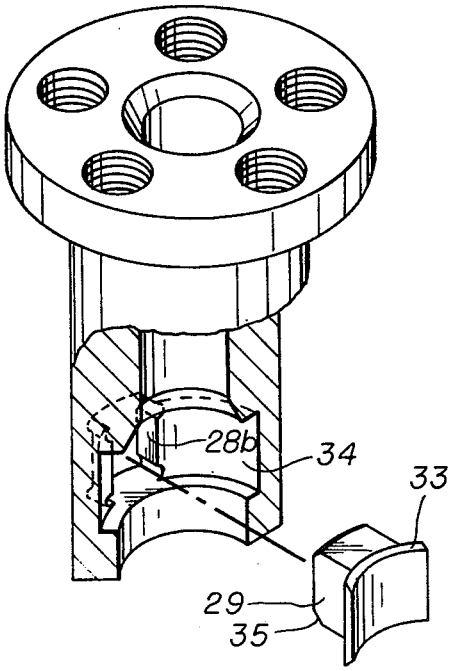
FIG. 6 is an enlarged isometric exploded view of the sleeve carrier portions broken away to illustrate the window and also showing the relationship of the latching dog or key to said carrier.
Figure 8:
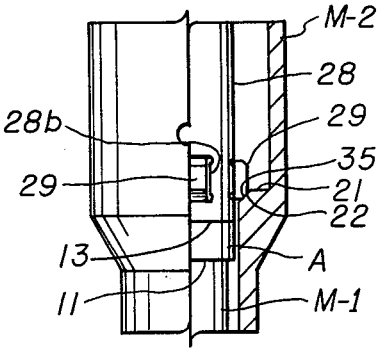
FIG. 8 is a longitudinal view partly in section and partly in elevation showing the latching dogs of the jar in the collapsed position.

In cross-section, each dog is constructed of a main block-like body portion which slidably fits within a window 28*b* (FIG. 5) to permit the dog to radially project through the window. Outward displacement of each dog is prevented by a curved stop flange 33 on its inner portion which engages the inner surface of an annular groove 34 formed within the bore of the carrier sleeve when the dog is in its outermost position. As shown in FIG. 6, the annular groove 34 is aligned with the windows 28*b* and retains each dog against vertical displacement during its radial or horizontal movement. The main body of each dog is projected through its window when the jar is in latched position (FIG. 8) and is retracted when the jar is in released position. The lower outer corner of the body of each dog is beveled to form an inclined surface 35 which is generally complementary to the angle of bevel 22 of latching shoulder 21 (FIG. 8). The inclined surface 35 of each dog engages bevel surface 22 when the resilient springs urge the carrier sleeve into latched position (FIG. 1). At this time, the inner surface of the flange 33 of each dog is opposite the back-up surface 14 and surfaces 35 and 22 are engaged with each other so that the members M-1 and M-2 are maintained in the latched position by the force of the coiled springs 32.

In operation, initially the jar members M-1 and M-2 of the jar are in the latched collapsed position and engaged with the stuck object. To apply an upward jarring force to the stuck object, an upward force or tension is exerted on the outer member M-2 by a pull on the wire line. Such upward pull on the wire line is transmitted by the latching shoulder 21 on the outer member M-2 through bevel surface 22 to each of the dogs. Since the dogs are projected through the windows in the outermost position, they are subjected to the upward force of the latching shoulder, and this force is transmitted through the sleeve carrier to the resilient springs 32. When the pull on the wire line applies sufficient force to the sleeve carrier to overcome the force of the springs, the dogs are urged upwardly along the back-up surface 14 until they move opposite the reduced diameter surface 15 of inner member M-1. The continued application of upward force through surfaces 22 and 35 causes the dogs to move inwardly and retract to the position shown in FIG. 2 which releases said dogs from the latching position. Such release permits movement of the outer member M-2 relative to the inner member M-1 and the force of the tension which was built up in the wire line is applied to the outer member to instantaneously and rapidly move the hammer H on said outer member into striking contact with the anvil A on said inner member. At this time, the jar is in fully extended position with the dogs receded into the windows (FIG. 2) and springs 32 fully collapsed. After jarring, the tension on the wire line is released and the springs 32 expand so that the jar returns to its collapsed and latched position. As the carrier sleeve 28 is moved downwardly along the inner member, the rear surface of each dog engages the beveled surface 15 which functions to move the dogs outwardly and onto the back-up or locking surface 14 so that the parts may return to the positions shown in FIG. 1. The operation can be repeated as many times as desired by reapplying upward pull on the wire line to overcome the resilient springs and effect release of the latch.

Figure 7:
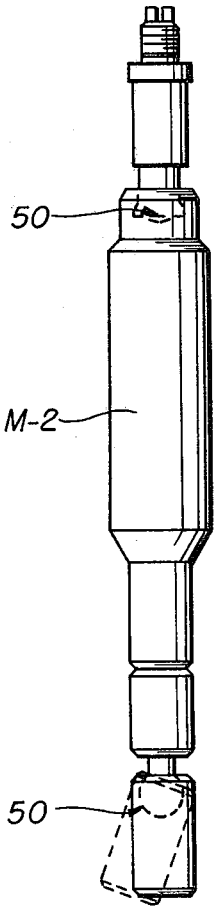
FIG. 7 is an exterior view of the jar showing adaptation for pump down operations.

The jar can be adapted for use in pump down operations by providing it with the usual flexible or ball joint connectors 50 on either end of the tool (FIG. 7). Because the jar is of relatively short length, it will be capable of being expanded to apply a jarring action by applying fluid pressure to the usual pump-down seals which are mounted at each end of the tool.

From the foregoing, it is evident that the improved jar provides a sturdy latch means designed for repetitive use with the telescoping members of the jar. The latch means includes a carrier sleeve with relatively heavy block-like dogs interposed between two members one of which carries the hammer and the other carries the anvil. Construction of the latch is designed so that the dogs will not separate from the sleeve carrier and jam the tool. Also, the latch maintains its integrity with prolonged use and will not fatigue or lose resiliency, as is the case with certain prior art latches which depend upon flexible flat springs or spring-pressed detent elements.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A jar including, an inner member, an outer housing member telescoping said inner member and movable from a collapsed to an extended position relative thereto, one of said members having means for supporting a well tool, an anvil surface and a hammer surface with one of said surfaces formed on one of the members and the other of said surfaces formed on the other of said members, said anvil and said hammer surfaces being spaced from each other when the inner and outer members are in a collapsed position, means slidably mounted on the inner member and having radial openings therein, a plurality of latching dogs each of which is movable in a direct radial path within one of the openings of said slidably mounted means, engageable with both members to latch the members in a collapsed position, and resilient means having its force acting upon said dogs to prevent disengagement of the dogs from one of the members until a sufficient force is applied to one of the members to overcome the force of said resilient means and permit the members to move relative to each other and cause the hammer to strike the anvil.

2. A jar as set forth in claim 1, together with:

means on said inner member adapted to attach to a stuck object within a well bore, whereby a jarring blow is imparted to said object when the jar is actuated.

3. A jar as set forth in claim 1, wherein:

the latching dogs are located in an annular space between the inner and outer members, and means on said inner member coacting with said dogs when the force of the resilient means is overcome to permit radially inward movement of said latching dogs which moves them to a retracted unlatched position.

4. A jar as set forth in claim 1, wherein:

the exterior of the inner member is formed with a locking surface which engages the inner surfaces of the dogs when the members are in a collapsed position to latch the members in such position, and a reduced diameter section on the exterior of said inner member immediately above said locking surface, whereby upward movement of the outer member and latching dogs relative to the inner member moves said dogs opposite said reduced diameter section and allows inward movement of the dogs to their retracted unlatched position.

5. A jar as set forth in claim 1, together with:

means within the bore of said outer member engageable with said latching dogs in such position that said means may apply an upward force to the dogs, a locking surface on said inner member engaged by said dogs to retain said dogs in engagement with the means within the bore of said outer member to maintain the members in latched position until a sufficient upward force is applied through the last-named means to overcome the force of the resilient means and permit the dogs to move to a retracted unlatched position.

6. A jar as set forth in claim 1, wherein:

the hammer surface is formed on the end of the outer housing member, and the anvil surface is intermediate the ends of the inner support member.

7. A jar including, an inner support member, an outer housing member telescoping said inner support member and movable from a collapsed to an extended position relative thereto, an anvil surface and a hammer surface with one of said surfaces formed on one of said members and the other of said surfaces formed on the other member, said anvil and hammer surfaces being spaced from each other when the inner and outer members are in a collapsed position, latching means coacting with said inner and outer members to latch the same in collapsed position, said latching means including a carrier sleeve having a plurality of windows interposed between said inner and outer telescoping members, a plurality of latching dogs mounted in said windows of said carrier sleeve and carried by said sleeve and said latching dogs engageable with both members to latch the members in collapsed position, and resilient means acting upon said carrier sleeve and said dogs to prevent disengagement of the dogs from one of the members to overcome the force of the resilient means and permit the members to move relative to each other and thereby cause the hammer to strike the anvil.

8. A jar as set forth in claim 7, together with:

means on the inner support member adapted to be attached to a stuck object within a well bore, whereby a jarring blow is imparted to said object when the jar is actuated.

9. A jar as set forth in claim 7, wherein:

each latching dog comprises a block-like body portion having its lower outer corner beveled to form an inclined surface, an inclined actuating surface within the bore of the outer member engaging and coacting with the inclined surface on the body of the latching dog, whereby upward movement of the outer body will apply an upward force to the dogs sufficient to overcome the resilient means and cause the hammer to strike the anvil.

10. A jar as set forth in claim 7, wherein:

stop means on each latching dog coacting with said carrier sleeve to prevent complete outward displacement from said carrier sleeve, and said latching dogs being movable radially within the windows to projected or retracted position whereby said dogs are projected through said windows when the jar is in collapsed position and retracted within said windows when the jar is in extended position.

11. A jar as set forth in claim 7, wherein:

stop means on each of said latching dogs which coact with said carrier sleeve to prevent complete outward displacement from said carrier sleeve, said latching dogs being movable radially within said windows to projected or retracted position, the exterior of the inner member being formed with a locking surface which engages the dogs to lock the dogs in projected position when the jar members are in collapsed position, and a reduced diameter section on the exterior of the inner member immediately above said locking surface which allows inward movement of said latching dogs to a retracted and unlatched position when the jar members are in extended position.

12. A jar as set forth in claim 7, wherein:

each latching dog comprises a block-like body portion having its lower outer corner beveled to form an inclined surface, an inclined actuating surface within the bore of the outer member engaging and coacting with the inclined surface on the body of each latching dog, the exterior of the inner member being formed with a locking surface which engages the inner surfaces of each dog when the jar members are in collapsed position and said inclined actuating surface of said outer member is engaged and coacting with the beveled surface on the latching dogs, and a reduced diameter section on the exterior of said inner member immediately above said locking surface, whereby upward movement of the outer member and latching dogs relative to the inner member moves said dogs opposite said reduced diameter and allows inward movement of the dogs to retract the dogs to retracted position, whereby the inclined actuating surface of the outer member is disengaged from the actuating surface of the dogs and the jar members are permitted to move to their fully extended position.

13. A jar as set forth in claim 7, wherein:

the resilient means comprises a plurality of springs confined between the carrier sleeve and inner member whereby said springs urges the jar members to the latched, collapsed position.

14. A jar as set forth in claim 7, wherein:

the resilient means is a spring confined between the carrier sleeve and inner member whereby said spring urges the jar members to the latched, collapsed position and also wherein, the hammer surface is formed on the end of the outer housing member, and the anvil surface is intermediate the ends of the inner support member.

* * * * *